US012569736B1

(12) United States Patent
Gutierrez

(10) Patent No.: US 12,569,736 B1
(45) Date of Patent: Mar. 10, 2026

(54) APPARATUS FOR STORING A BAT

(71) Applicant: Eliezer Ivan Gutierrez, Houston, TX (US)

(72) Inventor: Eliezer Ivan Gutierrez, Houston, TX (US)

( * ) Notice: Subject to any disclaimer, the term of this patent is extended or adjusted under 35 U.S.C. 154(b) by 0 days.

(21) Appl. No.: 18/232,727

(22) Filed: Aug. 10, 2023

(51) Int. Cl.
*A63B 60/60* (2015.01)
*A63B 102/18* (2015.01)

(52) U.S. Cl.
CPC ..... *A63B 60/60* (2015.10); *A63B 2102/18* (2015.10)

(58) Field of Classification Search
CPC ..... A63B 60/60; A63B 2102/18
USPC ..... 220/735, 736; 248/311.2, 311.3, 312, 248/312.1, 314
See application file for complete search history.

(56) References Cited

U.S. PATENT DOCUMENTS

| | | | | | |
|---|---|---|---|---|---|
| 811,742 | A | | 2/1906 | Petrie | |
| 878,233 | A | | 2/1908 | Paulson | |
| 2,494,995 | A | | 1/1950 | Gardner | |
| 2,828,047 | A | | 3/1958 | Weiselberg | |
| 3,280,744 | A | | 10/1966 | Brown | |
| 3,907,183 | A | | 9/1975 | Shearer | |
| 4,163,374 | A | | 8/1979 | Moore | |
| 4,439,884 | A | * | 4/1984 | Giorni | B08B 1/00 15/160 |
| 4,544,351 | A | | 10/1985 | Marsicano | |
| 4,644,610 | A | | 2/1987 | Fish | |
| 4,720,023 | A | | 1/1988 | Jeff | |
| 4,776,456 | A | * | 10/1988 | Lewis | A47K 11/10 206/229 |
| 4,793,532 | A | | 12/1988 | Cash | |
| 4,856,220 | A | | 8/1989 | Oak | |
| 4,976,411 | A | | 12/1990 | Gordon | |
| 5,297,767 | A | | 3/1994 | Miller | |
| 5,308,406 | A | * | 5/1994 | Wallock | B08B 3/04 15/21.2 |
| 5,471,706 | A | * | 12/1995 | Wallock | B08B 1/12 15/310 |
| 5,782,448 | A | | 7/1998 | Withun | |
| 5,979,329 | A | | 11/1999 | Collar | |
| 6,170,787 | B1 | | 1/2001 | Morgan | |
| 6,227,426 | B1 | | 5/2001 | Martin | |
| 6,457,415 | B1 | | 10/2002 | Sung Yan | |
| 6,491,267 | B1 | | 12/2002 | Feldman | |
| 6,508,369 | B2 | | 1/2003 | Wang | |

(Continued)

OTHER PUBLICATIONS

MFI Medical, "Sports Medicine Equipment and Supplies from MFI Medical", p. 1 (Year: 2025).*

(Continued)

*Primary Examiner* — Alfred J Wujciak
(74) *Attorney, Agent, or Firm* — Matthew Compton; Adair Myers

(57) ABSTRACT

An apparatus for storing a bat, a bat stand, may comprise a cylindrical body, a base, a ring, and a finger plate. The ring may thread to the top of the body and help secure a finger plate in the interior of the bat stand. The base of the stand may be wider than the body so as to lower the center of gravity and increase the stability of the bat stand. The finger plate may be made of a rubber base supporting a fabric top. The finger plate may have multiple fingers that help to center a bat vertically within the bat stand. In some embodiments, screws secure the ring to the body with the finger plate in between.

20 Claims, 19 Drawing Sheets

(56) References Cited

U.S. PATENT DOCUMENTS

| | | | | |
|---|---|---|---|---|
| 6,681,519 | B2 | 1/2004 | Cone | |
| 6,702,128 | B2 | 3/2004 | Winig | |
| D493,056 | S | 7/2004 | Shornak | |
| 7,287,474 | B2 | 10/2007 | Whitley | |
| 7,413,244 | B2 | 8/2008 | Tanaka | |
| 7,540,462 | B1 | 6/2009 | Beden | |
| 8,991,598 | B2 | 3/2015 | Whitworth | |
| 11,457,775 | B2 | 10/2022 | Youn | |
| 2004/0025530 | A1 | 2/2004 | Perrins | |
| 2005/0072330 | A1 | 4/2005 | Whitley | |
| 2006/0006294 | A1 | 1/2006 | Harris | |
| 2006/0244280 | A1 | 11/2006 | Sugawara | |
| 2009/0095865 | A1 | 4/2009 | Everhart | |
| 2012/0227610 | A1 | 9/2012 | Reichart | |
| 2012/0312185 | A1 | 12/2012 | Marietta | |
| 2016/0220886 | A1 | 8/2016 | Hernandez | |
| 2019/0029224 | A1* | 1/2019 | Murphy | A46B 15/0091 |
| 2019/0104820 | A1 | 4/2019 | Williams | |

OTHER PUBLICATIONS

Sportsfield.com, All-Weather Aluminum Bat & Helmet Storage Units, May 10, 2023, Sportsfield.com, USA, https://www.sportsfield.com/products/baseball-softball-equipment/bat-helmet-storage-units/aluminum, All-Weather_Aluminum_Bat_Helmet_Storage_Units_Sportsfield_Special.pdf.

Shopbck.com, BallQube Baseball Bat Display (Mountable), May 10, 2023, Shopbck.com, Shorewood, IL, USA, https://shopbck.com/ballqube-baseball-bat-holder/, BallQube_Baseball_Bat_Display_(Mountable)-The_Baseball_Card_King.pdf.

Kduhe, Baseball Bat Holder stock photo, May 10, 2023, istockphoto.com, USA, https://www.istockphoto.com/photo/baseball-bat-holder-gm139913432-1753498, Baseball_Bat_Holder_Stock_Photo.pdf.

PDPlay, Baseball Bat Rack, May 10, 2023, PDPlay, USA, https://pdplay.com/product/baseball-bat-rack/, Baseball_Bat_Rack-Sports-PDPlay_Playgrounds_For_This_Planet.pdf.

Joe Kelly, Baseball/Softball bat holder DIY Do It Yourself Pattern, May 10, 2023, Etsy.com, USA, https://www.etsy.com/listing/510644653/baseballsoftball-bat-holder-diy-do-it, Baseball_softball_Bat_Holder_DIY_PATTERN.pdf.

Aalcomfg.com, Baseball Equipment—Bat Racks, May 10, 2023, Aalcomfg.com, St. Louis, MO, USA, http://www.aalcomfg.com/products/baseball/bat-racks/, Bat_Racks-AALCO-Manufacturing.pdf.

Reeds Family Outdoor Outfitters, Berkley Rod Rack—Tube—White TR1W, May 10, 2023, Reeds Family Outdoor Outfitters, USA, https://www.reedssports.com/fishing/berkley-rod-rack-tube-white-tr1w-028632028896, Berkley_TR1W_028632028896_Berkley_Rod_Rack-Tube-White-TR1W.pdf.

P&M Solutions, LLC DBA DoMyOwn, Bird Barrier Batcone 2 Bat Deterrent (n8-bc05), May 10, 2023, P&M Solutions, LLC DBA DoMyOwn, USA, https://www.domyown.com/bird-barrier-batcone-bat-deterrent-n8bc05-p-8458.html, Bird_Barrier_Bat_Cone_2_Bat_Deterrent_n8-bc05.pdf.

Britax , Britax Child Cup Holder for Britax Convertible Car Seats—Dishwasher Safe, Black, May 10, 2023, Amazon, USA, https://www.amazon.com/Britax-Convertible-Child-Holder-Black/dp/B00OTXQZ8K?th=1, Britax_Child_Cup_Holder_for_Britax_Convertible_Car_Seats.pdf.

Champion Sports Store, Champion Sports Bat Caddy Multi, 42" X 52" Holds 12 Bats, May 10, 2023, Amazon, USA, https://www.amazon.com/Champion-Sports-BH1000-Bat-Caddy/dp/B0000AWE5J/, Champion_Sports_Bat_Caddy_Multi_42_X_52_Holds_12-Bats.pdf.

Derteio, Derteio Modern Creative Multi-Purpose Umbrella Stand,PVC Umbrella Holder, for Roll Paper Walk Sticks Baseball Bat, for Home Office, May 10, 2023, Amazon, USA, https://www.amazon.com/DERTEIO-Creative-Multi-Purpose-Umbrella-Baseball/dp/B09WHVCMGQ, DERTEIO_Modern_Creative_Multi-Purpose_Umbrella_Stand_PVC.pdf.

UnlimitedCreationsTy, HookItUpCup, Dugout Organizer, Personalized, Fence Holder, Storage, Hook, Sport, May 10, 2023, Etsy.com, Auburn, AL, USA, https://www.etsy.com/listing/817839699/hookitupcup-dugout-organizer, Hookitupcup_Dugout_Organizer_Personalized_Fence_Holder.pdf.

Tim Leland, How to Replace Honda Pilot Console Cup Holder (2009-2015), May 10, 2023, Tim Leland, USA, https://timleland.com/how-to-replace-honda-pilot-console-cup-holder-2009-2015/, How_to_Replace_Honda_Pilot_Console_Cup_Holder_(2009-2015)_Tim-Lelan_.pdf.

Mixfeer, Mixfeer Car Cup Holder Dual Cup Holder Insert Drink Cupholder Interior Drinking Cup Bracket Black Replacement for Yukon 07-14, May 10, 2023, Walmart.com, USA, https://www.walmart.com/ip/MIXFEER-Car-Cup-Holder-Dual-Cup-Holder-Insert-Drink-Cupholder-Interior-Drinking-Cup-Bracket-Black-for-GMC-Yukon-07-14/554610837, Mixfeer_Car_Cup_Holder_Dual_Cup_Holder_Insert_Drink_Cupholder.pdf.

Fixtures Close Up, PVC Quivers as Driveway Marker Retail Rack, May 10, 2023, Fixtures Close Up, Drums, PA, USA, https://www.fixturescloseup.com/2012/01/31/pvc-quivers-for-retail/, PVC_Quivers_As_Driveway_Marker_Retail_Rack-Fixtures_Close_Up.pdf.

Sea Striker, Sea Striker PVC Sand Spikes for Surf Fishing | Sand Spikes with Aluminum Stop Pin, May 10, 2023, Amazon, USA, https://www.amazon.com/Sea-Striker-Spikes-Fishing-Aluminum/dp/B0010FDGJ6?th=1, Sea_Striker_PVC_Sand_Spikes_for_Surf_Fishing-Sand_Spike.pdf.

Stickstow.com, StickStow Baseball Bat Holder, May 10, 2023, Stickstow.com, Roseville, MN, USA, https://stickstow.com/baseball-bat-holder/, Stickstow_baseball_bat_holder.pdf.

Stickstow.com, Broom Closet Stick Holder Wall Mounted Space Saver, May 10, 2023, Stickstow.com, Roseville, MN, USA, https://stickstow.com/broom-closet-stick-holder-wall-mounted-space-saver/, Stickstow_Broom_Closet_Stick_Holder_Wall_Mounted_Space_Saver.pdf.

Stickstow.com, StickStow Main Website, May 10, 2023, Stickstow.com, Roseville, MN, USA, https://stickstow.com/, Stickstow_main_page.pdf.

PYT Sports, Grizzly Dugout Bat Storage, May 10, 2023, PYT Sports, Bridgeview, IL, USA, https://pytsports.net/product/grizzly-bat-box, The_Grizzly-MLB_Style_Dugout_Bat_Racks_PYT_Sports.pdf.

Charnish, Inc., Vintage Brass Umbrella Stand Cane Walking Stick Holder, May 10, 2023, Charnish, Inc., USA, https://www.chairish.com/product/6470869/vintage-brass-umbrella-stand-cane-walking-stick-holder, Vintage_Brass_Umbrella_Stand_Cane_Walking_Stick_Holder_Chairish.pdf.

Dorman, Dorman 41001 Cup Holder Compatible, May 10, 2023, Amazon, USA, https://www.amazon.com/Dorman-41001-Cup-Holder-Insert/dp/B004WLXRGC, Dorman_41001_Cup_Holder.pdf.

Dexas, Dexas MudBuster Portable Dog Paw Washer/Paw Cleaner, Small, Pro Blue, Jun. 14, 2023, Amazon, USA, https://www.amazon.com/Dexas-MudBuster-Portable-Washer-Cleaner/dp/B084GYFS55?th=1, Texas_Mud_Buster_June_14_2023.pdf.

* cited by examiner

APPARATUS FOR STORING A BAT

FIELD OF THE INVENTION

The present invention relates to stands for holding sporting goods.

BACKGROUND OF THE INVENTION

It is difficult and awkward for a player in a game, for example a club-level baseball player, to store their bat(s). Some dugouts have bat storage racks or tubes. But these may be far away from the player or inaccessible in some circumstances. Often, no dugout is available. Bats lying on the ground or floor may be a tripping hazard, can get stepped on and dented or damaged, and may also be difficult to find amongst other bats and gear. Bats are also difficult to store during transport or in a backpack.

BRIEF DESCRIPTION

There are various embodiments of the invention. One embodiment of the invention is a bat stand for holding a bat vertically within it. The bat stand comprises a body having an upper half, a lower half, and one or more walls defining a cavity within the body. The bat stand has a base located on the lower half of the body. The bat stand has a finger plate with a plurality of fingers. The bat stand may have a ring comprising a threaded portion, the threaded portion for connecting to a correspondingly threaded portion of the body. The ring and body when threaded together secure the fingerplate to the upper half of the body.

In one embodiment, the body is cylindrical. In another embodiment, the base has a threaded portion, the threaded portion for connection to a correspondingly threaded portion of the body. In another embodiment, the base is integral with the body. In some embodiments, the base may be wider than the body.

In some embodiments, the finger plate may have tabs projecting radially outward from the center of the finger plate. In another embodiment, the finger plate has an aperture and a plurality of spikes radiating outward from the aperture, the aperture and spikes defined by two or more fingers. In one embodiment, the ring comprises, on a lower surface of the ring, a spike or ridge for securing the finger plate. In another embodiment, an upper surface of the body has a spike or ridge for securing the finger plate.

In some embodiments, the ring may have on an exterior surface of the ring, a hole to receive a screw that may traverse the ring radially from the exterior of the ring towards the center of the ring via the hole. The body comprises in some embodiments, on an exterior surface of a wall of the body, a hole to receive a screw that may traverse the body wall radially from the exterior of the body towards the center of the body via the hole. In another embodiment, the ring comprises, on an exterior surface of the ring, a hole to receive a screw that may traverse the ring radially from the exterior of the ring towards the center of the ring via the hole.

In another embodiment, the bat stand has a cylindrical body having an upper and a lower half. The body has a base located on the lower half of the body, and one or more walls defining a cylindrical cavity within the body. The cavity has an interior surface. The bat stand has a finger plate. The finger plate has a plurality of fingers and is disposed within a gap defined by the interior surface in the cavity of the body, the gap being located on the upper half of the body.

In another embodiment, the body has a top surface with a hole for a screw, where the screw may enter the body through the hole and secure the finger plate within the gap. The finger plate may be, in some embodiments, secured in the gap with glue or epoxy. In an alternative embodiment, the body has a top surface with a hole for a screw, and wherein the screw may enter the body through the hole and secure the finger plate within the gap by penetrating through the finger plate.

In another embodiment, a bat stand has a body with an upper half, a lower half, a threaded hole on a top surface of the body, and one or more walls defining a cavity within the body. The bat stand's base is wider than the body and located on the lower half of the body. The bat stand has a ring comprising a hole extending from a top surface of the ring to a bottom surface of the ring. The bat stand also has a finger plate disposed on the upper half of the body between the ring and the body. The finger plate has a plurality of fingers, where a screw may traverse the hole in the ring and thread into the threaded hole of the body thereby securing the finger plate between the ring and the body. The finger plate may, in some embodiments, have a hole to permit the passage of the screw.

DETAILED DESCRIPTION

Figure 1:
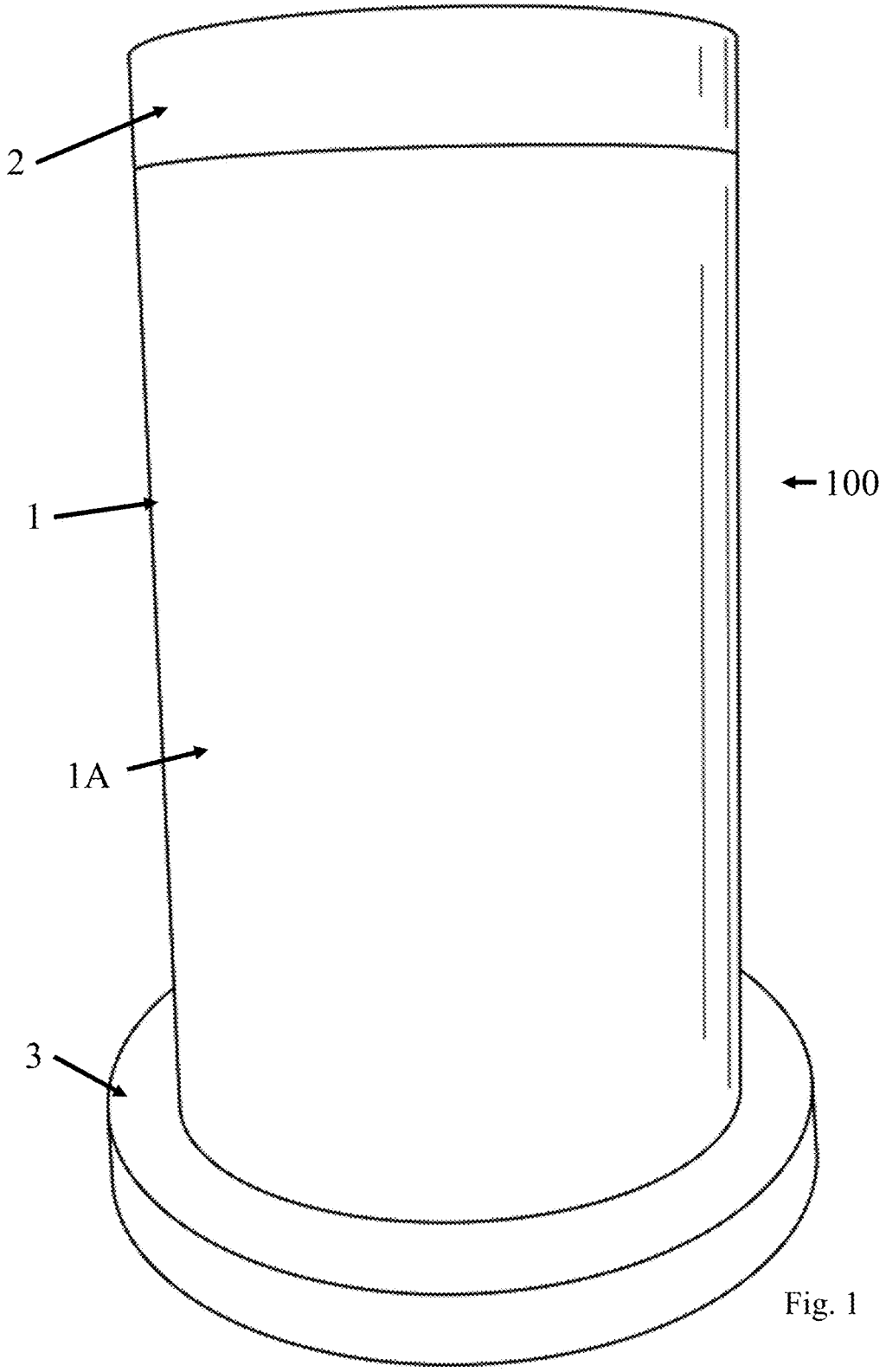
FIG. 1 is a perspective view of an embodiment of a stand for a bat having a cylindrical-shaped body.

FIG. 1 depicts a perspective view of an embodiment of a stand 100 for a bat having a cylindrical-shaped body 1. A threaded ring 2 is threaded onto the top of the body 1 on the upper half of the body 1. The body has a circular base 3 on the lower half of body, which in the embodiment shown in FIG. 1 is integral with the cylindrical body 1. The body 1 has a wall that defines a cavity (e.g., the hollow interior of the body 1, not shown in FIG. 1). In some embodiments, the body 1 may be shaped like a rectangular cuboid. In some embodiments, the base 3 may be square or rectangular. In some embodiments, the base 3 is not integral with the body 1 and instead may be threaded, bolted, glued, friction fit, or snap fit, to the bottom of the body 1.

In some embodiments, the body 1, ring 2, and base 3 are aluminum or some other metal (e.g., iron, steel, copper). In some embodiments, the body 1, ring 2, and base 3 are made out of plastic, for example, polyvinyl chloride (PVC), Acrylonitrile butadiene styrene (ABS), High-density polyethylene (HDPE), Polycarbonate (PC), or polypropylene (PP). In some embodiments, the body 1 is one material (e.g., a plastic), while the base 3 is made of another material (e.g., aluminum or steel) so as to lower the center of gravity of the stand 100. In some embodiments, the ring 2 may be made of a more durable or more shatter-resistant material so as to resist repeated impacts from placing an object (e.g., a bat) into the stand 100. In some embodiments, each of the body 1, ring 2, and base 3 are made of different materials.

Figure 2:
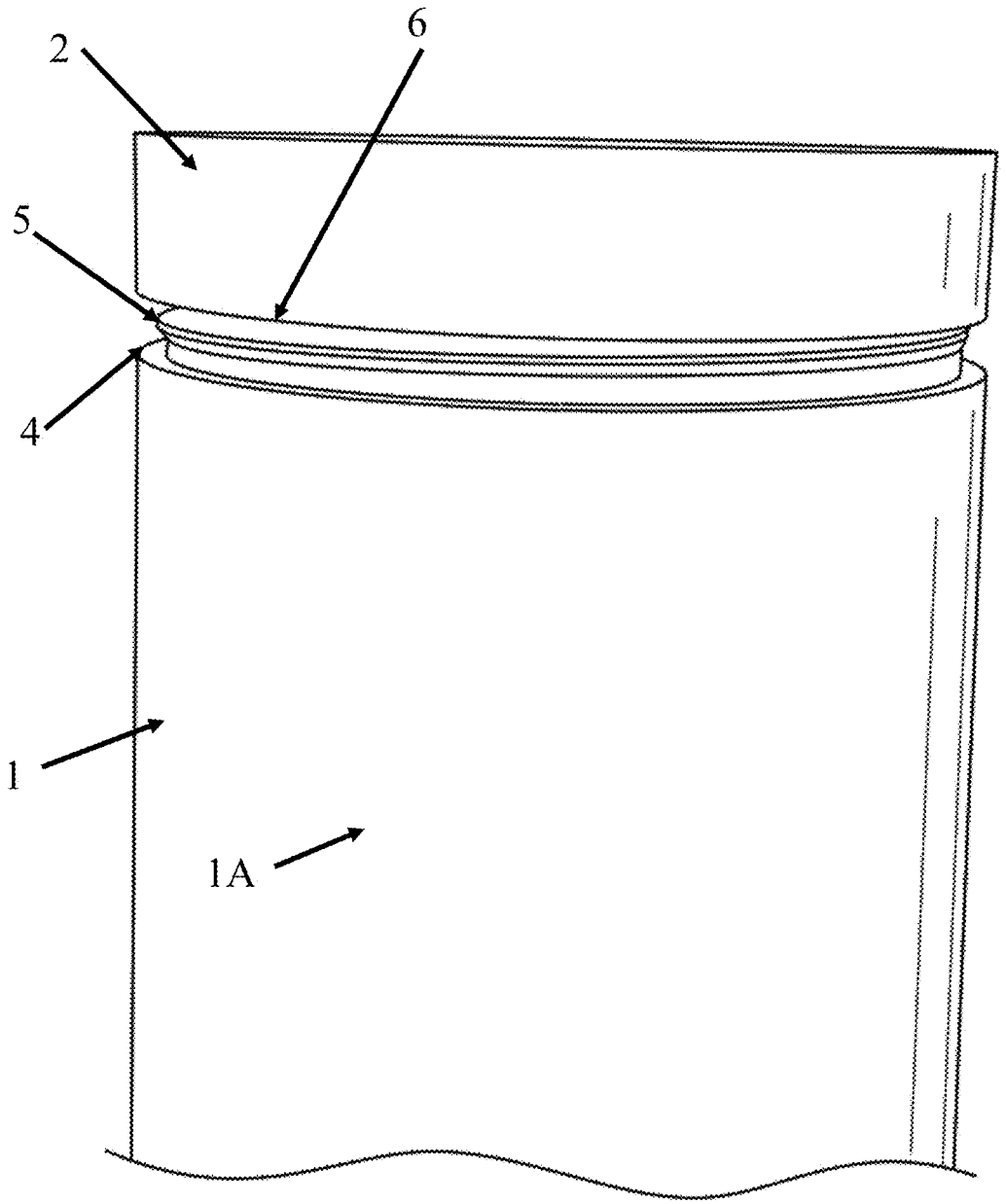
FIG. 2 is a side perspective view of an upper portion of an embodiment of a stand for a bat with a ring partially threaded onto the top of the body of the stand.

FIG. 2 depicts a side perspective view of an upper portion of a stand for a bat with the ring 2 partially threaded onto the top of the wall of the body 1. The body 1 has an upper lip 4 and a threaded portion (here a male thread 5) projecting upwards. The ring 2 has a lower lip 6 and a corresponding threaded portion (here a female thread 7 not shown) to receive the male thread 5. The lower lip 6 of the ring 2 may abut the upper lip 4 of the body 1 when the ring 2 is fully threaded onto the body 1. In some embodiments, the ring 2 has a male thread that projects downward and the body 2 has a corresponding female thread in its interior to receive the male thread of the ring 2. In some embodiments, the ring 2 may be glued, friction fit, or snap fit to the body 1.

Figure 3:
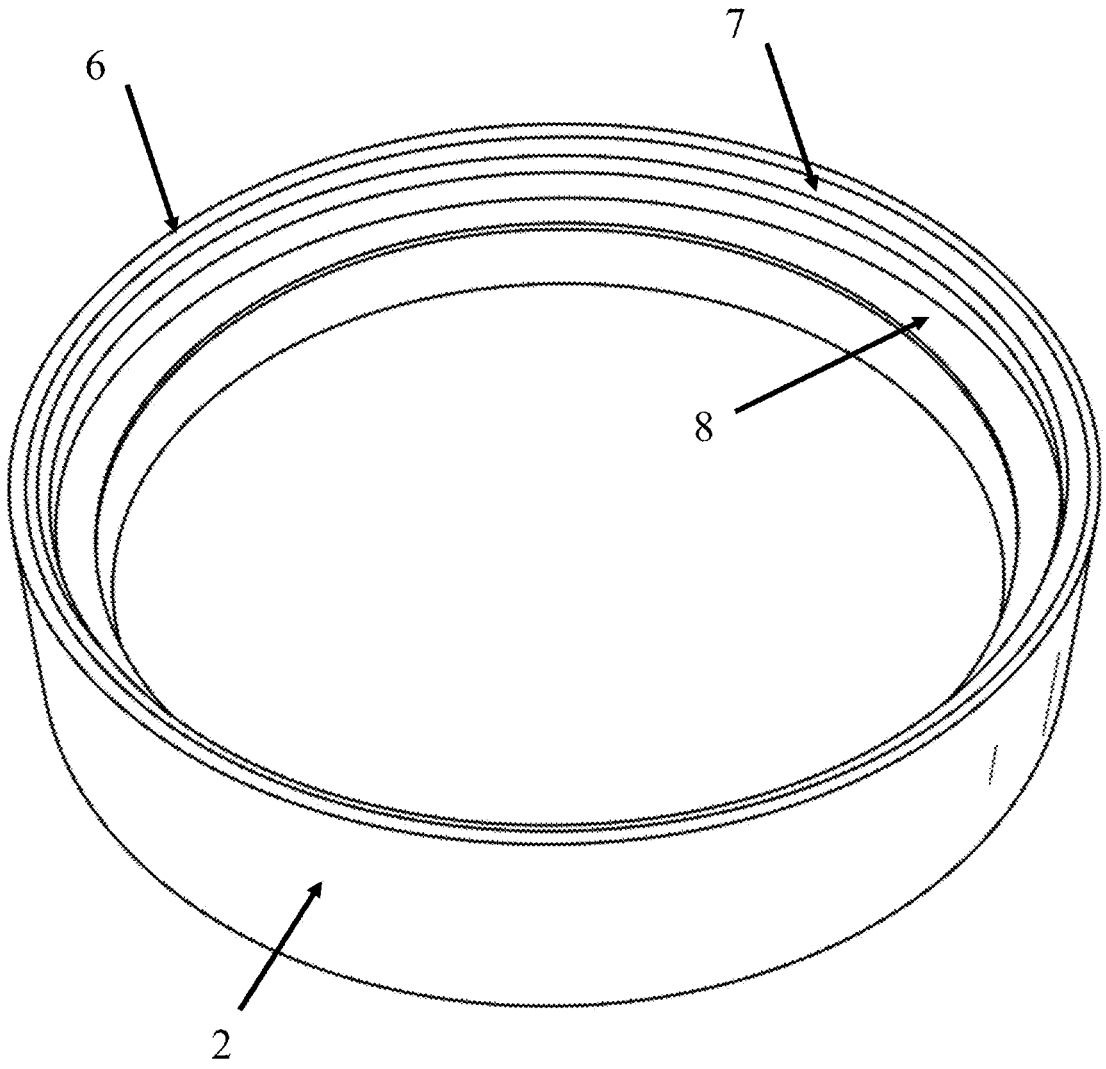
FIG. 3 is a perspective view of the bottom of an embodiment of a ring for a stand for a bat.
Figure 4:
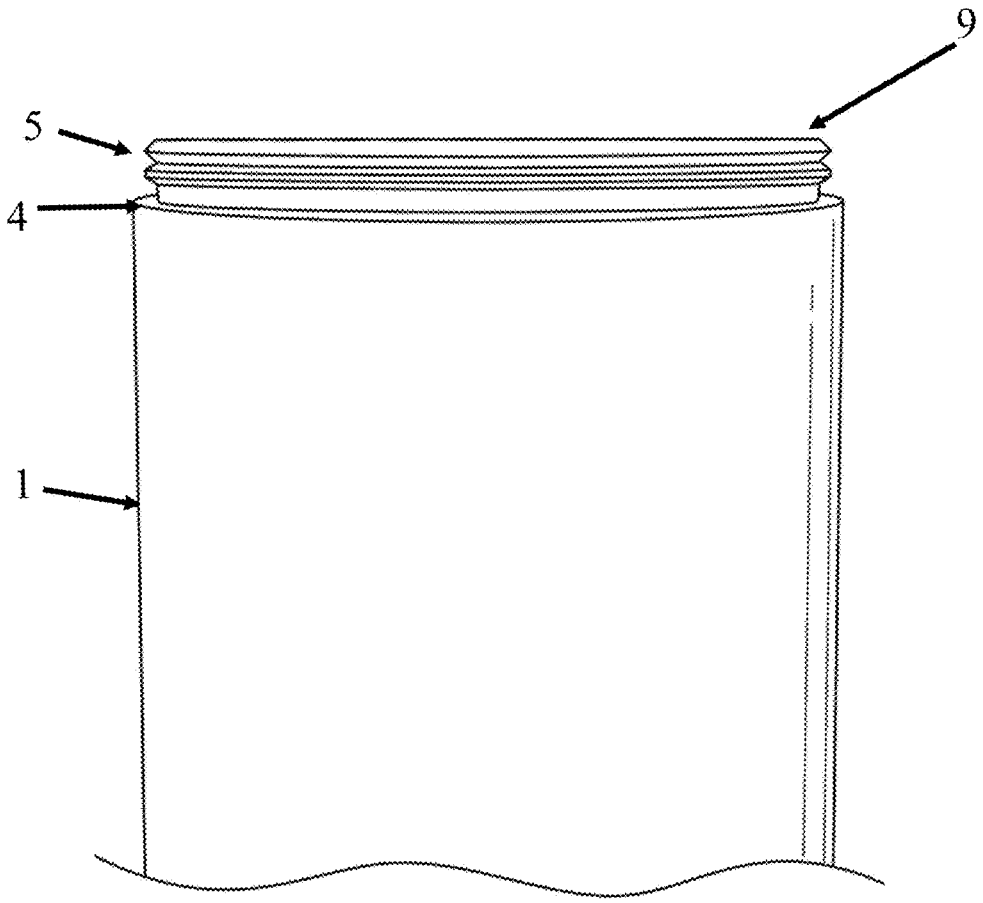
FIG. 4 is a side perspective view of an upper portion of an embodiment of a stand for a bat without a ring present.

FIG. 3 is a perspective view of the bottom of an embodiment of a ring 2. FIG. 4 is a side view of body with the ring 2 removed and the male thread 5 exposed. In FIGS. 3-4, the ring has a female thread 7 and a lower lip 6. The ring 2 also has a lower ridge 8 that may in some embodiments be used to hold a finger plate (not shown) by compressing the finger plate against the upper rim 9 of the body's 1 male thread 5.

Figure 5:
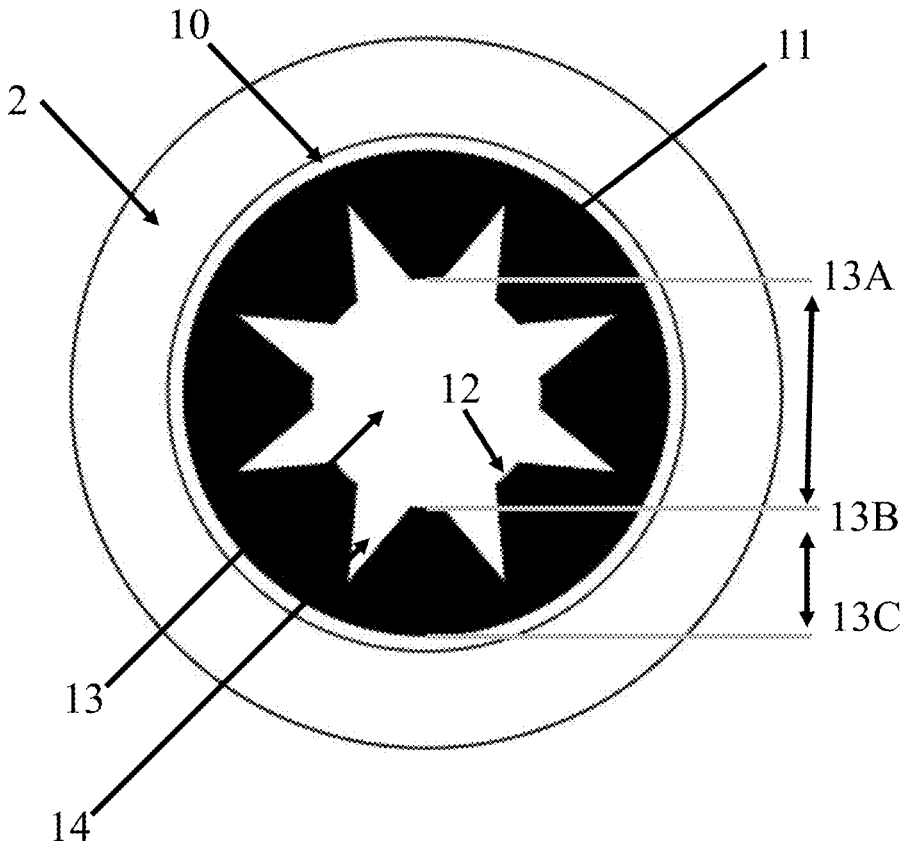
FIG. 5 is a top-down perspective of an embodiment of a stand for a bat.

FIG. 5 depicts a top-down view of the stand 100 showing a top surface of the ring 2, the ring's interior surface 10, and finger plate 11. The finger plate 11 has eight fingers 12 that project towards the center of the stand. In this embodiment, the fingers 12 create, with negative space, a star pattern with a round center aperture 13 and eight spikes 14. The aperture 13 is sized to receive the barrel of a bat (see, e.g., FIG. 13, item 29) and the fingers 12 act to keep the barrel centered in stand 100. The negative space of the spikes 14 allow the fingers 12 to bend and receive different sized bats. While the preferred embodiment is one that has a finger plate 11 shaped similar to what is shown FIG. 5, other finger plate shapes may be used.

One advantage of finger plate 11 is that the fingers 12 have limited contact with the barrel of a bat so that the bat may be withdrawn from the stand with minimal drag thereby helping keep the base of the stand from rising off of, or rising too far off, its resting place (e.g., the ground; the floor of a dugout). Nevertheless, possible embodiments of a finger plate include embodiments without an aperture 13 (e.g., a flap hinged on one side), embodiments with a reduced or enlarged aperture, embodiments with additional fingers, embodiments without spikes 14, and embodiments where the fingers of the finger plate fully extend into or even past the center of the stand (e.g., in the nylon brush finger plates discussed later). The distance between items 13A and 13B indicate the diameter of the aperture (or in the case of polygon aperture, a height). The distance between items 13C and 13B indicate the length of a finger as measured from the inner wall of the bat stand to the tip of a finger (in this example the finger's end has a circular cut such that the "tips" are not in the center of the finger). Some exemplary embodiments are set forth in Table 1 below.

TABLE 1

| Example | Aperture Dimension (Inches) |
|---|---|
| 1 | 0 |
| 2 | ⅛" |
| 3 | ⅜" |
| 4 | ⅜" |
| 5 | ⅝" |
| 6 | ⅝" |
| 7 | ⅝" |
| 8 | ⅞" |
| 9 | 1" |
| 10 | 1&⅛" |
| 11 | 1&⅜" |
| 12 | 1&⅜" |
| 13 | 1&⅝" |
| 14 | 1&⅝" |
| 15 | 1&⅝" |
| 16 | 1&⅞" |
| 17 | 2" |
| 18 | 2&⅛" |
| 19 | 2&⅜" |
| 20 | 2&⅜" |
| 21 | 2&⅝" |
| 22 | 2&⅝" |
| 23 | 2&⅝" |
| 24 | 2&⅞" |
| 25 | 3" |
| 26 | 3&⅛" |

In a preferred embodiment, the aperture ranges between 1" and 2&½" inclusive. In another preferred embodiment, the aperture is between 1&⅞" and 2&⅛" in diameter. A typical corresponding finger length in embodiments similar to FIG. 5 would be the one half of [the inner diameter of the bat stand less the diameter of the finger plate aperture]. Typical inner diameters of the bat stand (e.g., for typical bats such as those in Table 2) below may range from 4" to 2&⅜" inches. In one embodiment, for example, with respect to FIG. 1, the bat stand is in cylindrical form and 8 inches tall from the bottom of the base to the top of the ring. The outer diameter of the bat stand is 4" and the inner diameter is 3&½". The diameter of the base is 5". With respect to FIG. 2, in one embodiment, the ring is ¾" tall.

In some embodiments, the dimensionless ratio of the base to the height is 5 to 8. Other ratios include 5.1 to 8, 5.2 to 8, 5.3 to 8, 5.4 to 8, 5.5 to 8, 5.6 to 8, 5.7 to 8, 5.8 to 8, 5.9 to 8 and 6 to 8. Other rations include 4.9 to 8, 4.7 to 8, 4.6 to 8, 4.5 to 8, 4.4 to 8, 4.3 to 8, 4.2 to 8, 4.1 to 8, and 4 to 8. Generally a ratio of 1:2 through 3:4 may be acceptable based on the size of the bat(s) to be stabilized. Wider bases and/or taller heights may typically add additional stability for taller bats, while shorter bats may in some cases be stabilized with relatively narrower bases and/or shorter heights.

Figure 6:
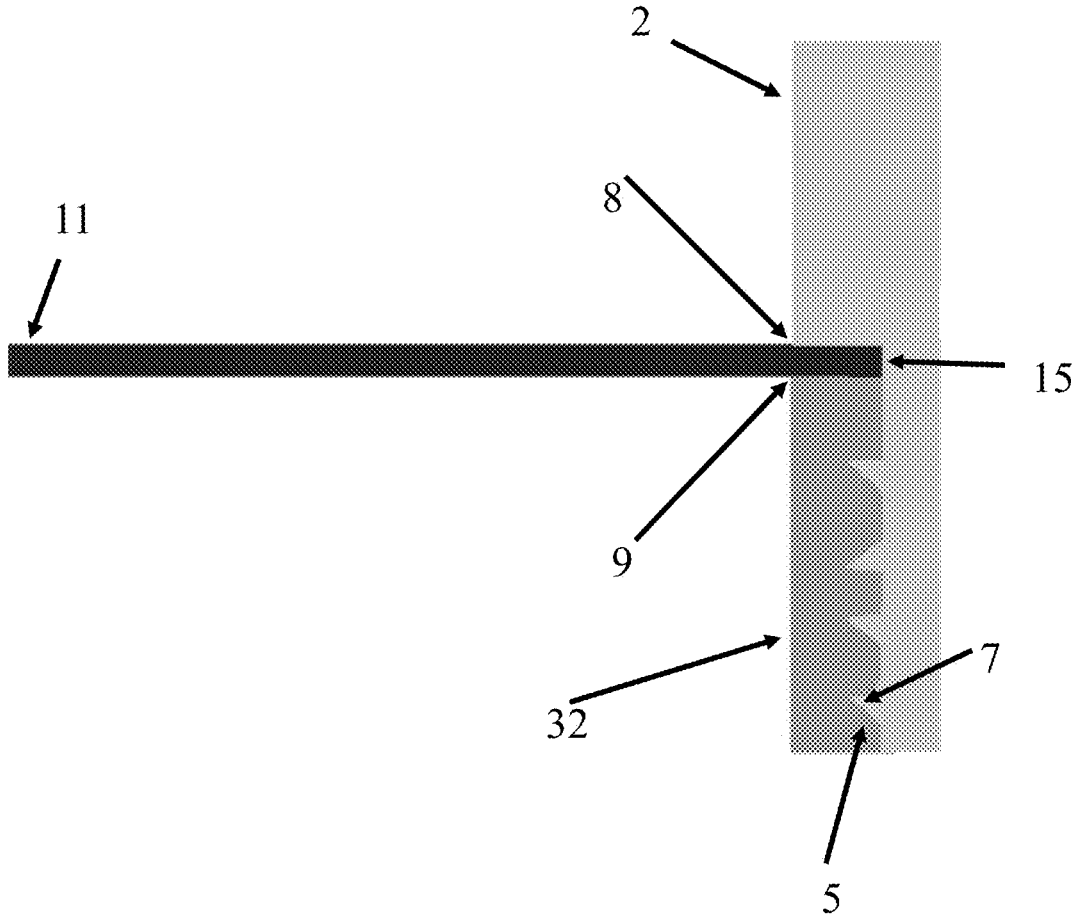
FIG. 6 is a partial cut-away side view of an embodiment of a stand for a bat that depicts attachment of a finger plate to the stand.

FIGS. 6-9 are partial cut-away side views that depict various methods of attachment for a finger plate 11. In these figures, the hollow body has an interior surface 32. In FIG. 6, the finger plate 11 is compressed in a gap 15 that is above the upper rim 9 of the male thread 7 of the body, and beneath the lower ridge 8 of the ring 2. By threading and tightening the ring 2 on the body of the stand, the gap 15 can be shrunk so as to exert compressive force on the fingers 11. In some embodiments, the lower lip of the ring (e.g., FIG. 3, item 6) will abut the top lip (e.g., FIG. 4, item 4) of the body before the gap 15 is fully closed. This offers some protection for the finger plate 11 so that additional tightening of the ring onto the body does not fully close the gap so as to cut through or damage the finger plate 11. In other embodiments, the lips may not meet when the gap 15 is fully closed. The ability to tighten the ring 2 and compress the finger plate 11 as much as desired may be preferred, for example, when the risk of damage to the finger plate 11 is negligible. In some embodiments, the finger plate 11 may be glued into the gap 15. This may, in some embodiments, yield sufficient affixation such that a compressive force from the ring 2 is not required.

Figure 7:
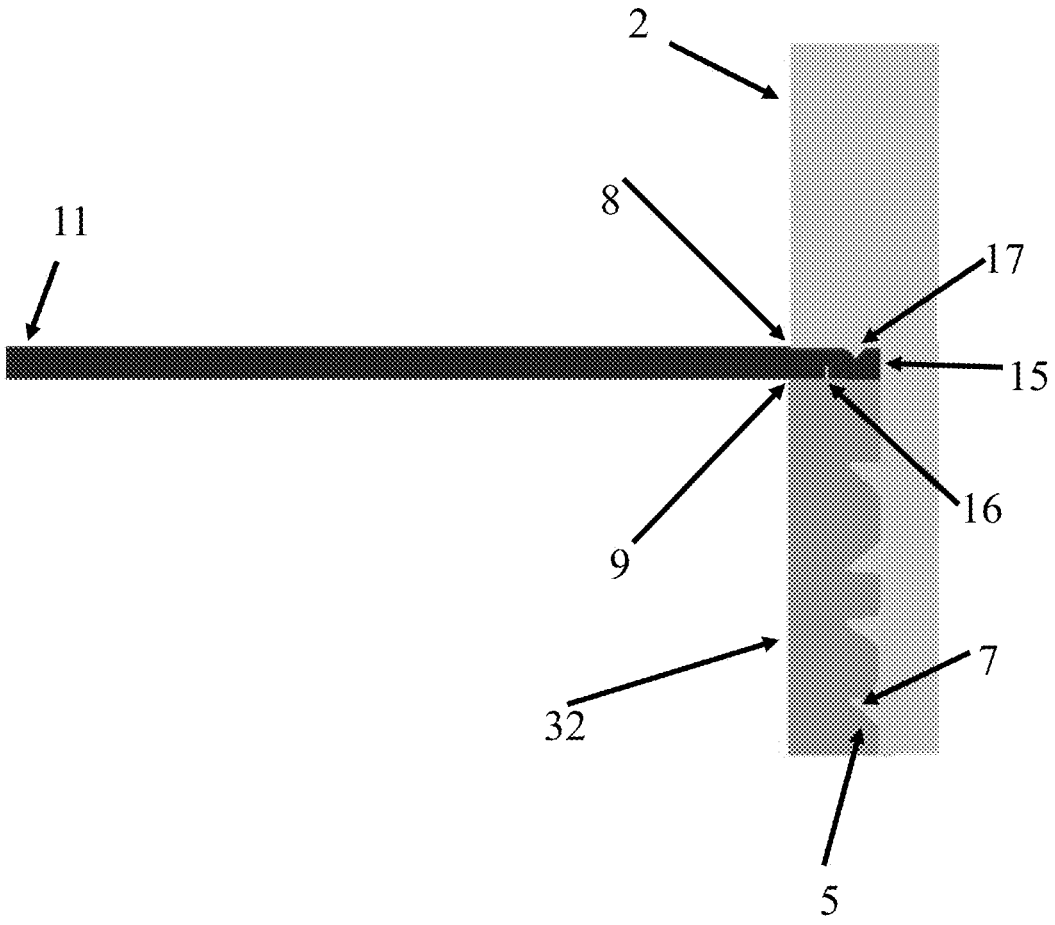
FIG. 7 is a partial cut-away side view of an embodiment of a stand for a bat that depicts additional methods of attachment of a finger plate to the stand.

In some embodiments, for example in FIG. 7, the upper rim 9 of the male thread 5 of the body (and/or the lower ridge 8 of the ring 2) make have a spike 16 or additional ridge 17 (with or without a corresponding indent or valley on the opposite side of the gap or in the finger plate 11) to increase friction forces and/or to penetrate into (or entirely through, for example in the case of a discontinuous ridge) the finger plate 11 thereby assisting in securing the finger plate 11 in the gap 15.

In another embodiment, one or more vertical screw holes may be present in the upper rim 9 of the male thread 5 so as to allow a finger plate 11 to be secured to the upper rim by screws. The ring 2 may then be threaded onto the body, and in some cases a gap 15 may provide sufficient space for the screws to not interfere with the ring 2.

Figure 8:
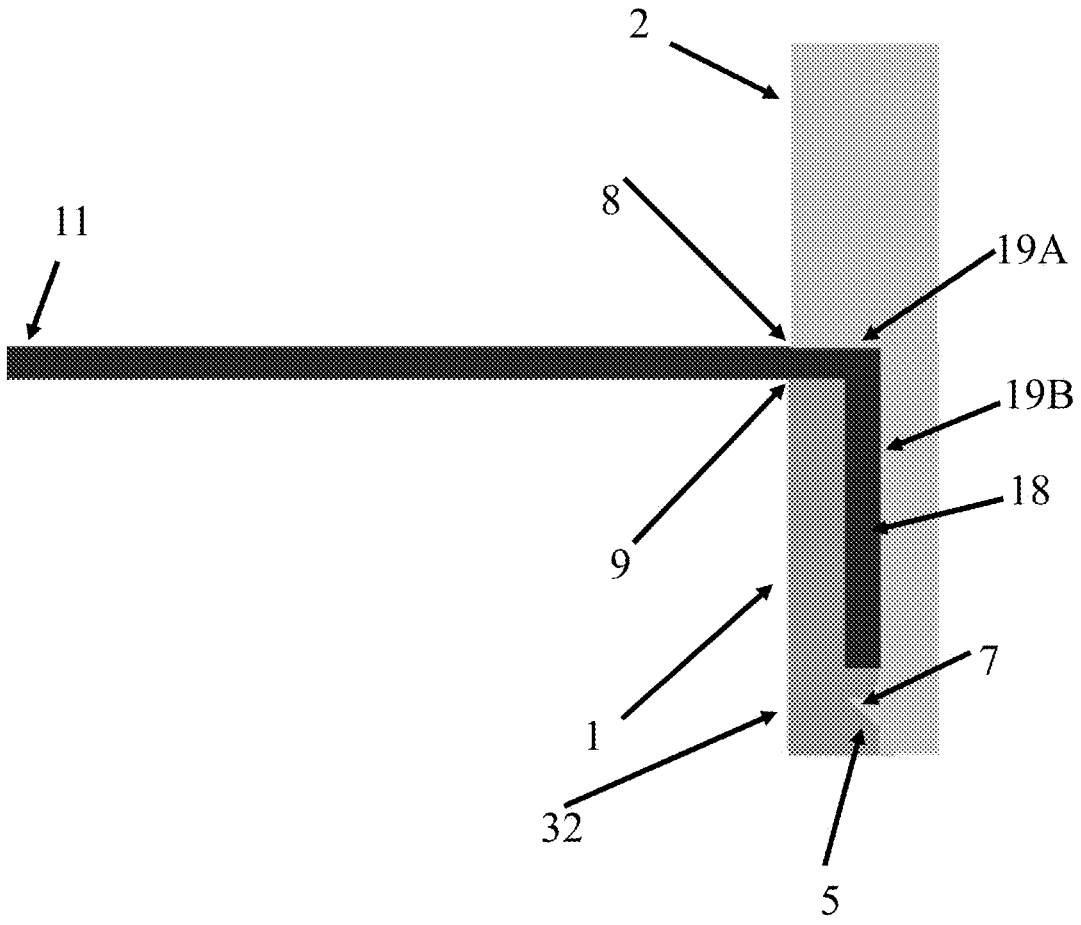
FIG. 8 is a partial cut-away side view of an embodiment of a stand for a bat that depicts additional methods of attachment of a finger plate to the stand.

In some embodiments, for example in FIG. 8, the finger plate 11 is compressed in an upper portion 19A of a gap that is above the upper rim 9 of the male thread 7 of the body, and beneath the lower ridge 8 of the ring 2. The lower portion 19B of the gap extends downward between the ring 2 and the body 1. Securing material 18 of the finger plate 11 extends downward into the lower portion 19B of the gap. By threading and tightening the ring 2 on the body of the stand, the upper portion 19A of the gap can be shrunk so as to exert compressive force on the fingers 11. The securing material 18 in the lower portion of the gap 19B creates additional friction and interference forces that help secure the finger plate 11 in the gap. As with FIG. 7, in some embodiments, the lower lip of the ring (e.g., FIG. 3, item 6) will abut the top lip (e.g., FIG. 4, item 4) of the body before the gap 15 is fully closed. In some embodiments, the lips may not meet when the gap 15 is fully closed.

In FIG. 8, the ring 2 is shown with female threads 7 for threading onto the male threads 5 of the body 1. In some embodiments, the securing material in the lower portion 19B gap, and/or the material in the upper portion 19A of the gap may be glued (e.g., with rubber cement, various plastic glues, or epoxy) to the body and/or the ring.

Figure 9:
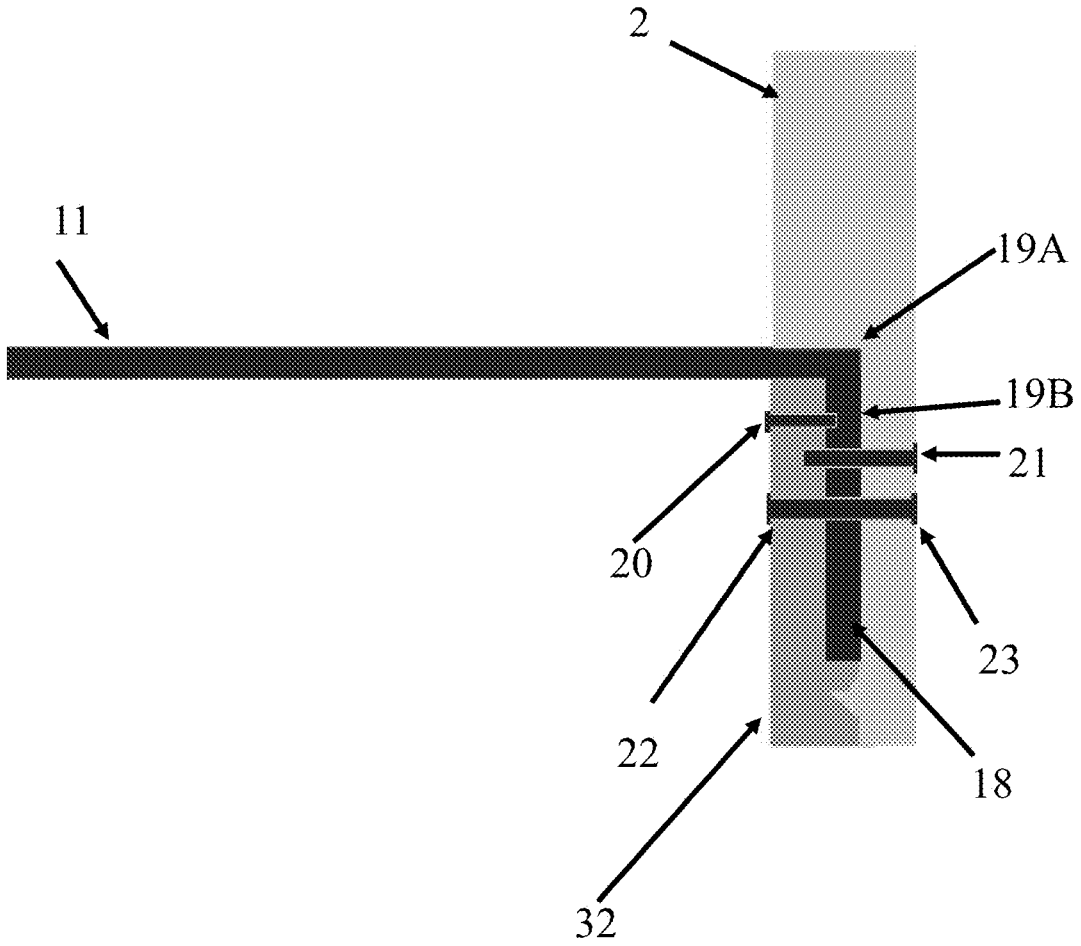
FIG. 9 is a partial cut-away side view of an embodiment of a stand for a bat that depicts additional methods of attachment of a finger plate to the stand.

In some embodiments, such as FIG. 9, one or more pins, bolts, or screws may be used to penetrate (into or through) the ring and/or the body so as to compress, or penetrate (into or through), the securing material 18 so as to help secure the finger plate 11 in the lower portion 19B of the gap. For example, in FIG. 9, a screw 20 is threaded from the hollow interior of the body 1 and penetrates into (or in some embodiments compresses) the securing material 18 of the finger plate 11. Here, the hole in the body 1 is threaded to receive the screw 20.

In another example, screw 21 is countersunk into the ring 2 and penetrates the ring 2 from the outside through a hole on the exterior surface of the ring, penetrates through the securing material 18 of the finger plate, and then penetrates into, but not through, the body 2. Here, one or both of the holes in the ring 2 and body 1 may be threaded to receive the screw 21.

In another example, a bolt 22 and a nut 23 are used. The bolt 22 penetrates through the body 1 from the interior, through the securing material 18 and through the ring 2. The nut 23 is countersunk into the ring 2, and the bolt 22 threads into the nut 23. In other examples, pins or rivets may be used in place of screws or bolts. While FIGS. 6-9 show multiple different methods and structures for securing the finger plate 11, the methods and structures may be used singly, or in combination with the others, or in combination with other securing methods.

Figure 16:
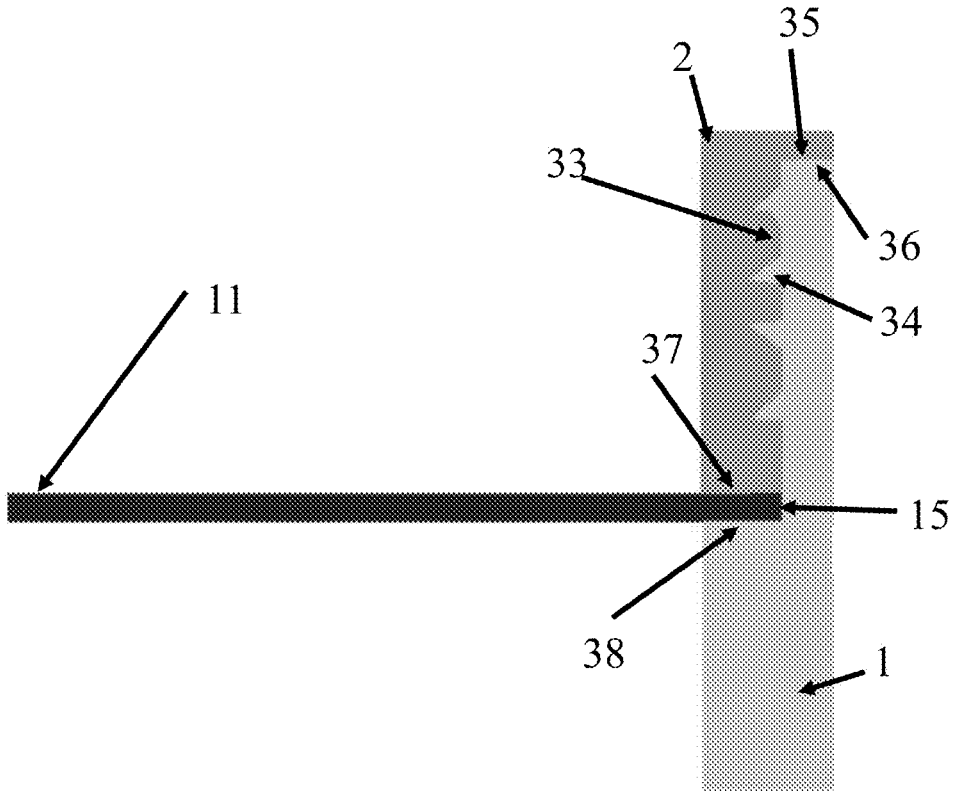
FIG. 16 is a partial cut-away side view of an embodiment of a stand for a bat that depicts additional methods of attachment of a finger plate to the stand.

While FIGS. 6-9 depict a ring having female threads with an outer portion of the ring facing on the outside of the stand, as shown in FIG. 16, the ring 2 may have a threaded portion (here male threads 33) for corresponding threaded portion (here female threads 34) of the body 1. In FIG. 16, the ring 2 has a lower rim 37. The body has an upper ridge 38. The finger plate 11 is compressed in a gap 15 that is above the upper ridge 38 of the body, and beneath the lower rim 37 of the ring 2. By threading and tightening the ring 2 on the body, the gap 15 can be shrunk so as to exert compressive force on the fingers 11. In some embodiments, the lower lip of the ring 35 will abut the upper lip 36 of the body before the gap 15 is fully closed. This offers some protection for the finger plate 11 so that additional tightening of the ring 2 onto the body 1 does not fully close the gap 15 so as to cut through or damage the finger plate 11. In other embodiments, the lips 35 & 36 may not meet when the gap 15 is fully closed. The ability to tighten the ring 2 and compress the finger plate 11 as much as desired may be preferred, for example, when the risk of damage to the finger plate 11 is negligible. (In some embodiments, the finger plate 11 may be glued into the gap 15. This may, in some embodiments, yield sufficient affixation such that a compressive force from the ring 2 is not required.) As with FIGS. 7, 8, and 9, corresponding spikes and protrusions (e.g., FIG. 7, items 16, 17) and gaps (e.g., FIG. 8, item 19B) and screws/bolts/pins (e.g., FIG. 9, items 20-23) may be used in connection with a male threaded ring and a female threaded body.

In another embodiment, one or more vertical screw holes may be present in the upper ridge 38 so as to allow a finger plate 11 to be secured to the upper rim by screws. The ring 2 may then be threaded onto the body, and in some cases the gap 15 may provide sufficient space for the screws to hold the finger plate while being compatible with the ring 2.

Figure 17:
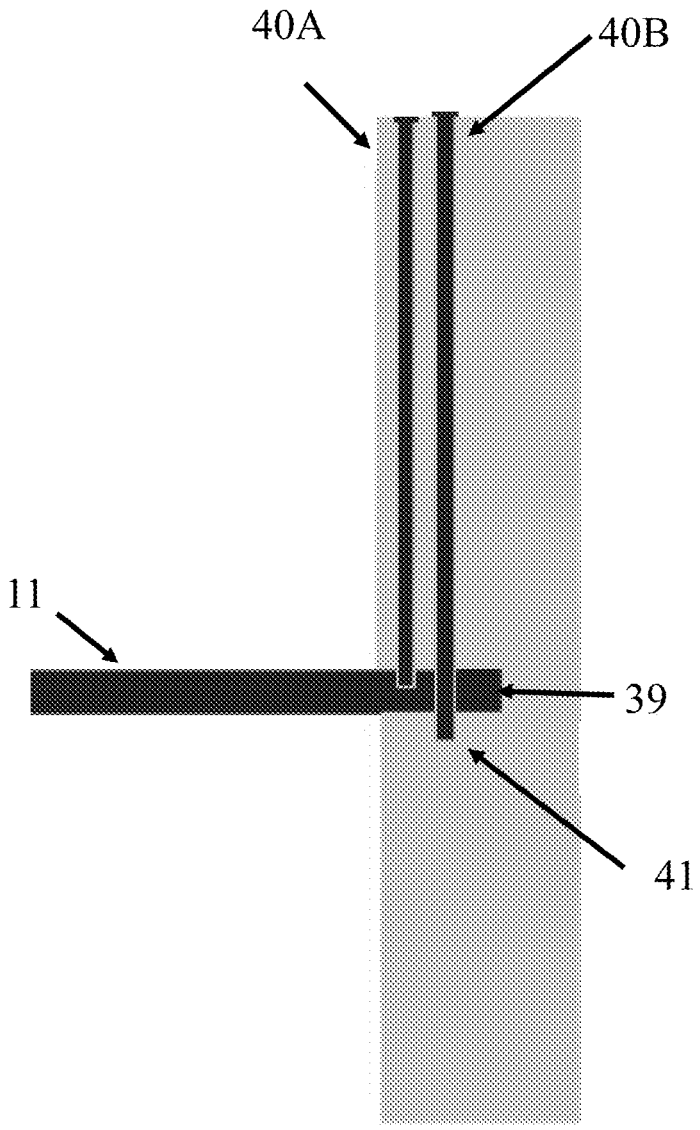
FIG. 17 is a partial cut-away side view of an embodiment of a stand for a bat that depicts additional methods of attachment of a finger plate to the stand.

While FIGS. 6-9 and 16 depict a ring that threads on top of the body, the ring may fully thread into the body. In some embodiments, a ring is not needed. For example, in FIG. 17, a ring-shaped cavity or gap 39 may be cut or formed in the interior of the body 1 to allow the finger plate 11 to rest inside the body 1. One or more screws 40A, 40B, may be used to secure the finger plate 11 inside the body 1. Screw 40A extends from a top surface of the body 1 through a hole in the body into the finger plate 11 (compressing or penetrating into it). Screw 40B extends from a top surface of the body 1 and entirely through the finger plate 11 and, in some embodiments, into a vertical cavity 41 (which may, but need not be, threaded) in the gap 39. In other embodiments, the floor of the gap 39 abuts the end of the screw 40B and no vertical cavity 41 is needed. In some embodiments, the finger plate 11 is secured in the gap 39 with glue or epoxy, potentially negating the need for any threading or screws.

Figure 18:
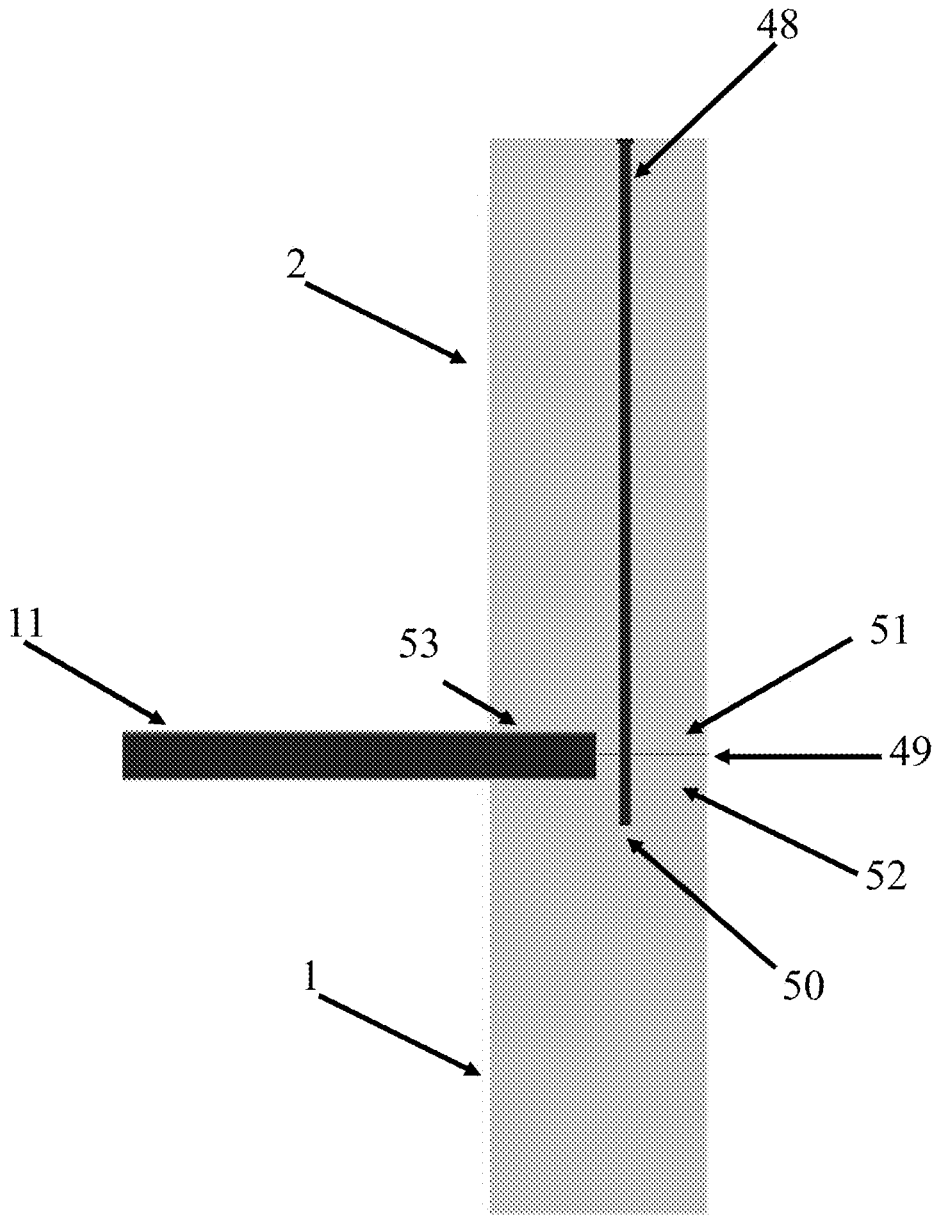
FIG. 18 is a partial cut-away side view of an embodiment of a stand for a bat that depicts additional methods of attachment of a finger plate to the stand.

FIG. 18 depicts another embodiment where the ring 2 is not threaded, but instead is secured to the top of the body 1 by one or more screws 48. The ring 2 has a lower ridge 51 that in conjunction with an upper ridge 52 of the body creates a 53 gap for the finger plate 11. When the screw 48 is installed, the screw traverses the ring through a hole extending from a top surface of the ring to a bottom surface of the ring, and threads into a hole 50 on a top surface of the body 1. In this manner the screw connects the ring 2 to the body 1, and also reduces a gap 49 between the ring 2 and the body 1. By closing the gap 49, the ring 2 and the body 1 may compress and help secure the finger plate 11 in place. In FIG. 18, the screw is shown as not penetrating the finger plate. In some embodiments, the screw may penetrate the finger plate (e.g., securing material of the finger plate). In some embodiments, the finger plate 11 is secured in the gap 53 with glue or epoxy, and glue or epoxy also securing the ring 2 to the body 1, thus potentially negating the need for any threading or screws.

In some embodiments, the lower ridge 51 will not abut the upper ridge 52 of the body and the gap 49 will not be fully closed. This offers some flexibility to secure the finger plate 11. The ability to tighten the ring 2 and compress the finger plate 11 as much as desired may be preferred, for example, when the risk of damage to the finger plate 11 is negligible. As with FIG. 7, spikes and protrusions (e.g., FIG. 7, items 16, 17) and other securing methods (e.g., glue) may be used in connection with this embodiment of FIG. 18. In some embodiments, no upper 51 or lower ridge 52 may be present, and the finger plate 11 is sandwiched between the ring 2 and the body 1 with the screw(s) 48 acting to secure the ring and body and finger plate together. In such a case the screw(s) 48 may penetrate the finger plate 11 (e.g., the finger plate itself or securing material of the finger plate).

Figure 10:
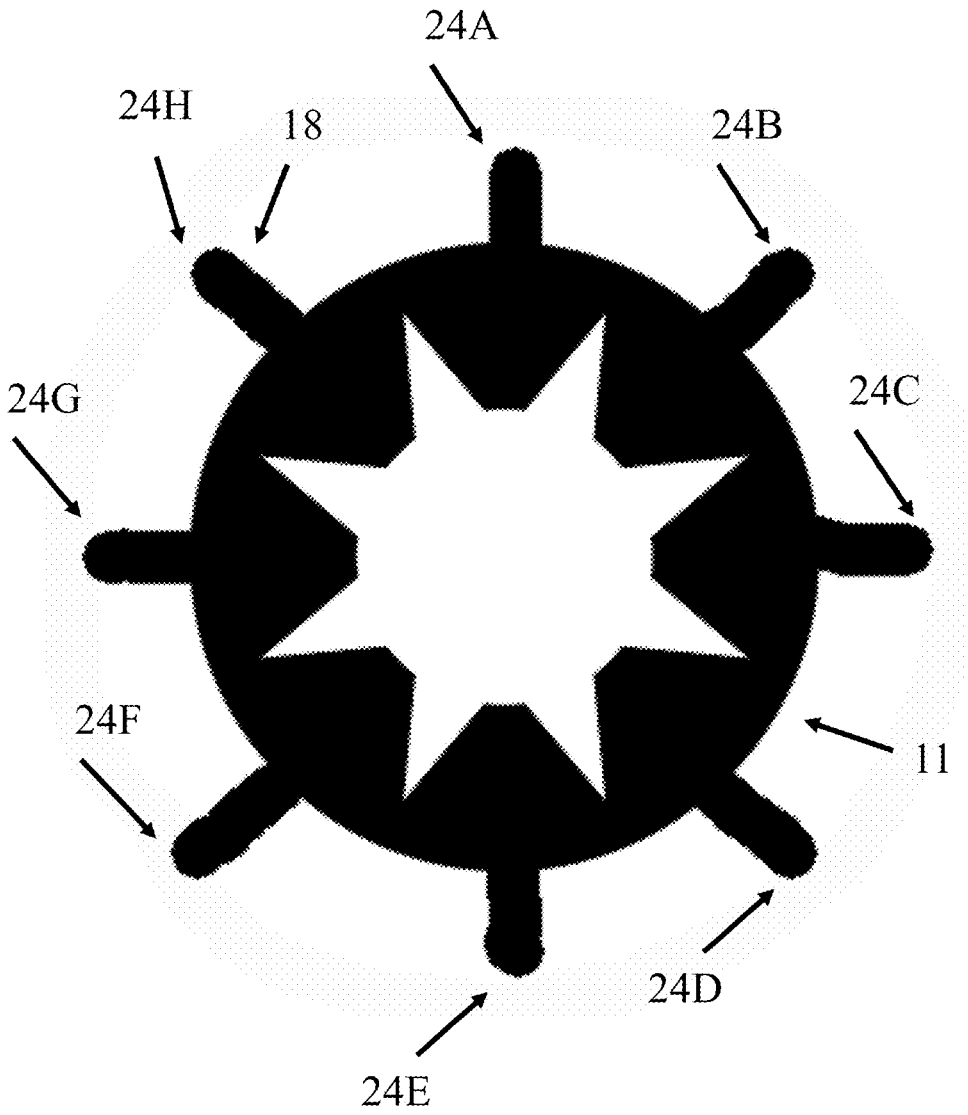
FIG. 10 is a top-down view of an embodiment of a finger plate with securing material tabs.

FIG. 10 is an embodiment of a finger plate 11 with securing material 18. The securing material tabs 24A-24H may extend from the plate radially outward. While eight tabs are shown in FIG. 10, any number of tabs from 1 to 16, or potentially more could be used. The tabs may also have different shapes than shown in FIG. 10.

Figure 11:
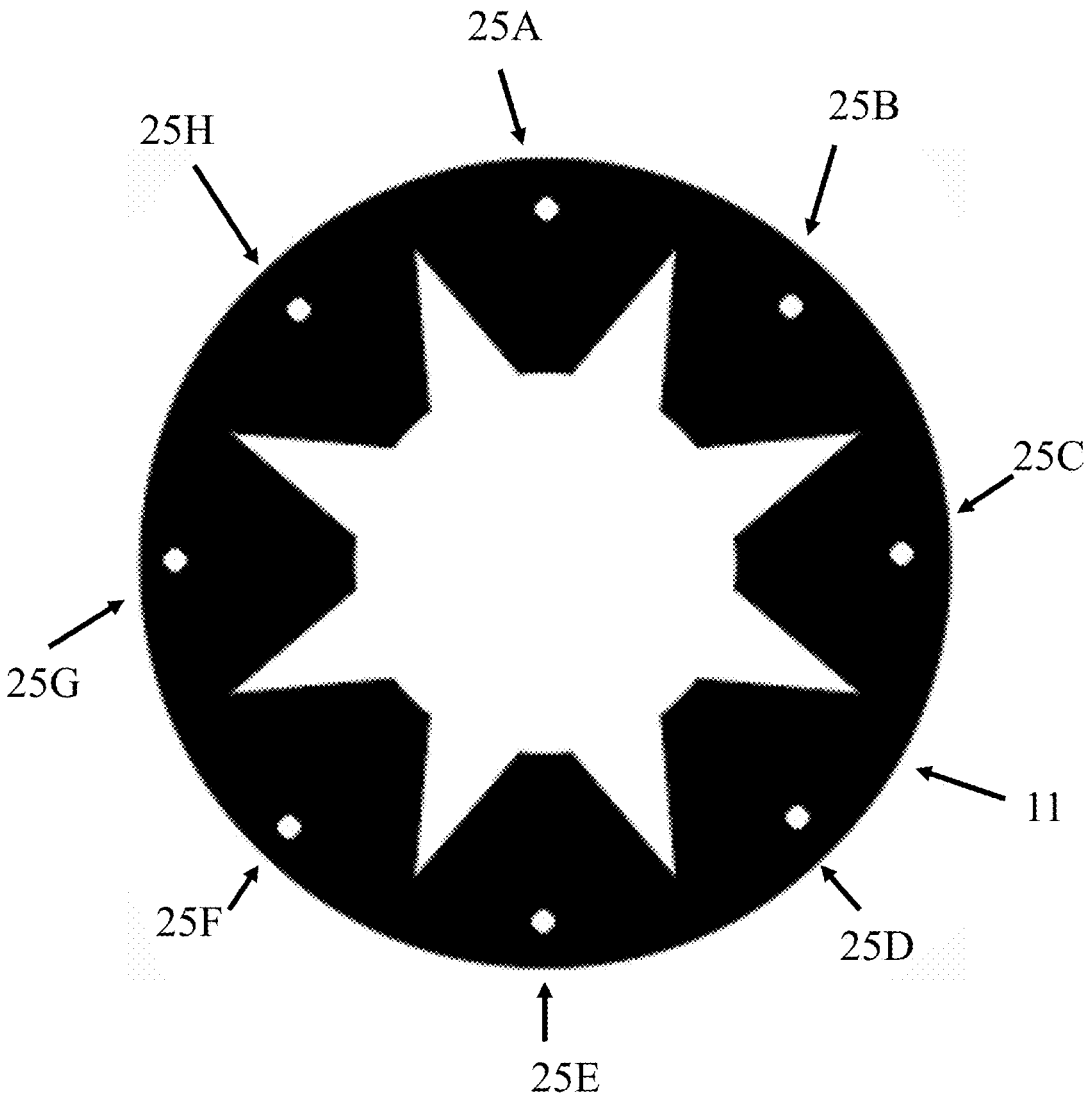
FIG. 11 is a top-down view of an embodiment of a finger plate with spike holes.

FIG. 11 is an embodiment of a finger plate 11 with spike holes 25A-25H. The spike holes 25A-25H may be used in connection with prongs, spikes, protrusions, or ridges on the body or ring as shown in part in FIG. 7 (e.g., items 16 and 17). While eight spike holes are shown in FIG. 11, any number of spike holes from 1 to 16, or potentially more could be used. The spike holes in FIG. 11 are shown as round, but may be elongated or oval or slotted or have some other shape.

Figure 12:
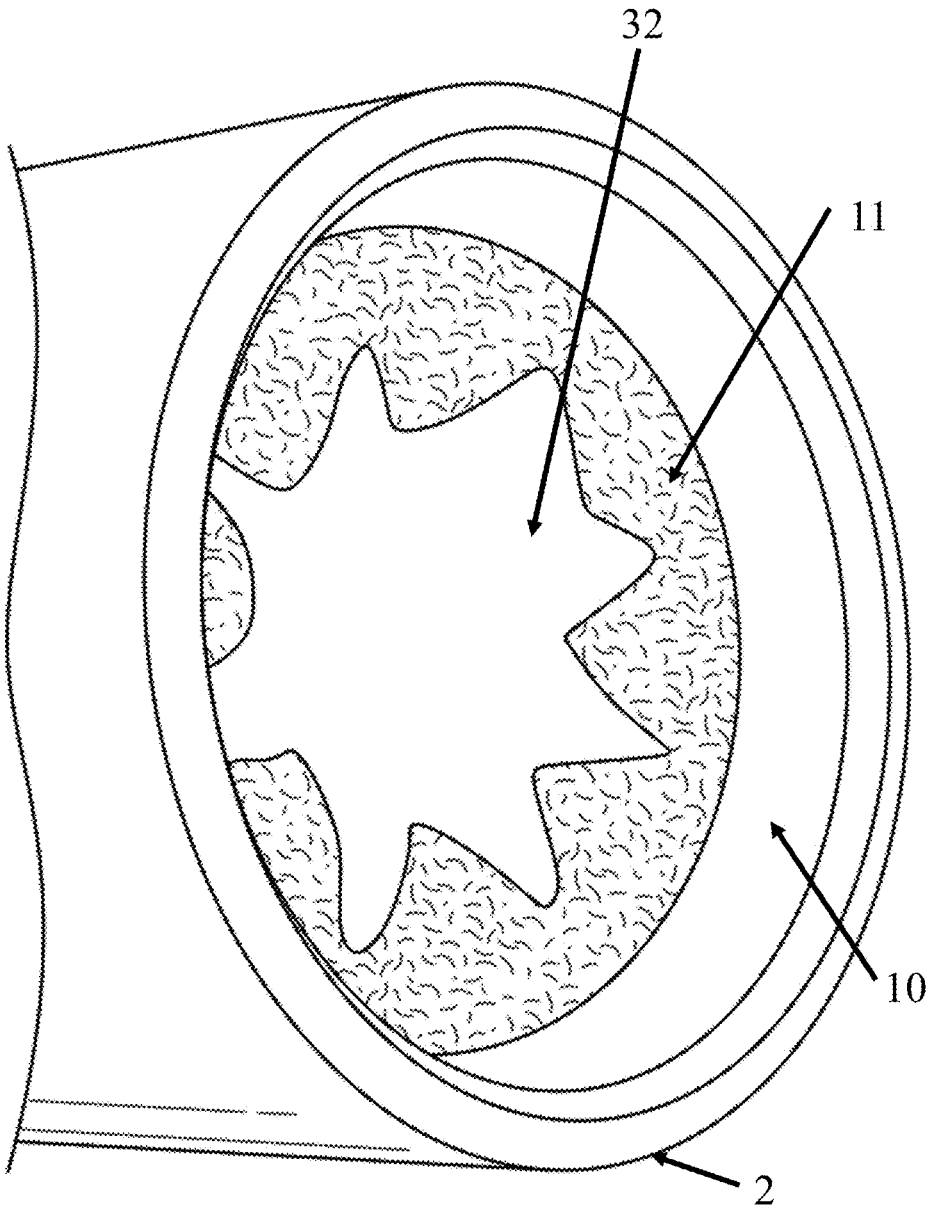
FIG. 12 is a perspective view looking into the interior of an embodiment of a stand.

FIG. 12 is a perspective view looking into the interior of the body 1 of the stand 100. The finger plate 11 is present. An interior surface 10 of the ring 2 is visible. An interior surface 32 of the body is also visible.

Figure 19:
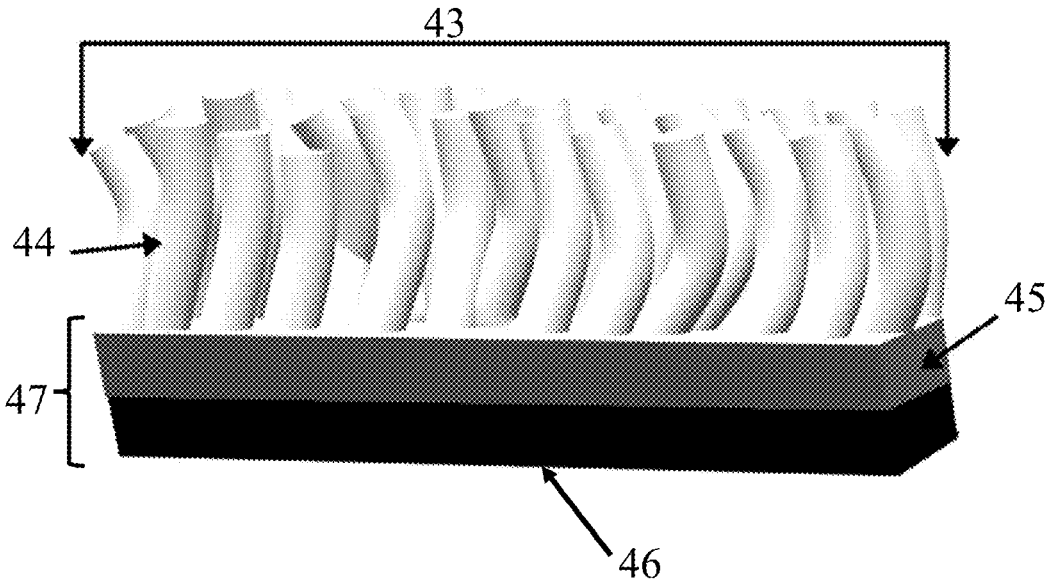
FIG. 19 is a partial cut-away side view of material for one embodiment of a finger plate.

FIG. 19 shows a cross section of an exemplary type of material for a finger plate 11. Item 43 is a fabric top or pile. The pile 43 has individual strands 44, but instead of strands, loops, or a combination of loops and strands, may be used. The strands 44 are embedded in a rubber base 47 which has a primary backing 45 and a secondary backing 46. The primary backing may be of a type of rubber that best helps to secure the strands 44 and the secondary backing 46 may be of a type of rubber that is more durable and rigid than the primary backing. Additional backing and/or bonding layers may also be present. In some embodiments, the rubber base 47 only has a single layer. The rubber base's flexible and spring-like nature generally pushes the fingers into the bat, helping to secure it in place. The fabric top 43 helps reduce the friction between the finger plate and the bat so as to allow the bat to enter and exit the body's cavity easily.

In a preferred embodiment, the finger plate 11 is made from a rubber base with a polyester and polypropylene blended fabric top. In other embodiments, neoprene with an outer fabric (e.g., polyester and/or polypropylene) may be used. The base of the finger plate need not be rubber or neoprene, other materials like vinyl, polyvinylchloride, or flexible plastics may be used. The fabric does not need to be a blended fabric, single types (e.g., cotton, burlap, polyester, polypropylene) may be used. Combined materials (e.g., rubber base with fabric top) need not be used, the finger plate may be made of a single material, for example, flexible plastics. Other materials like recycled vehicle tires or home carpeting may also be used.

Figure 13:
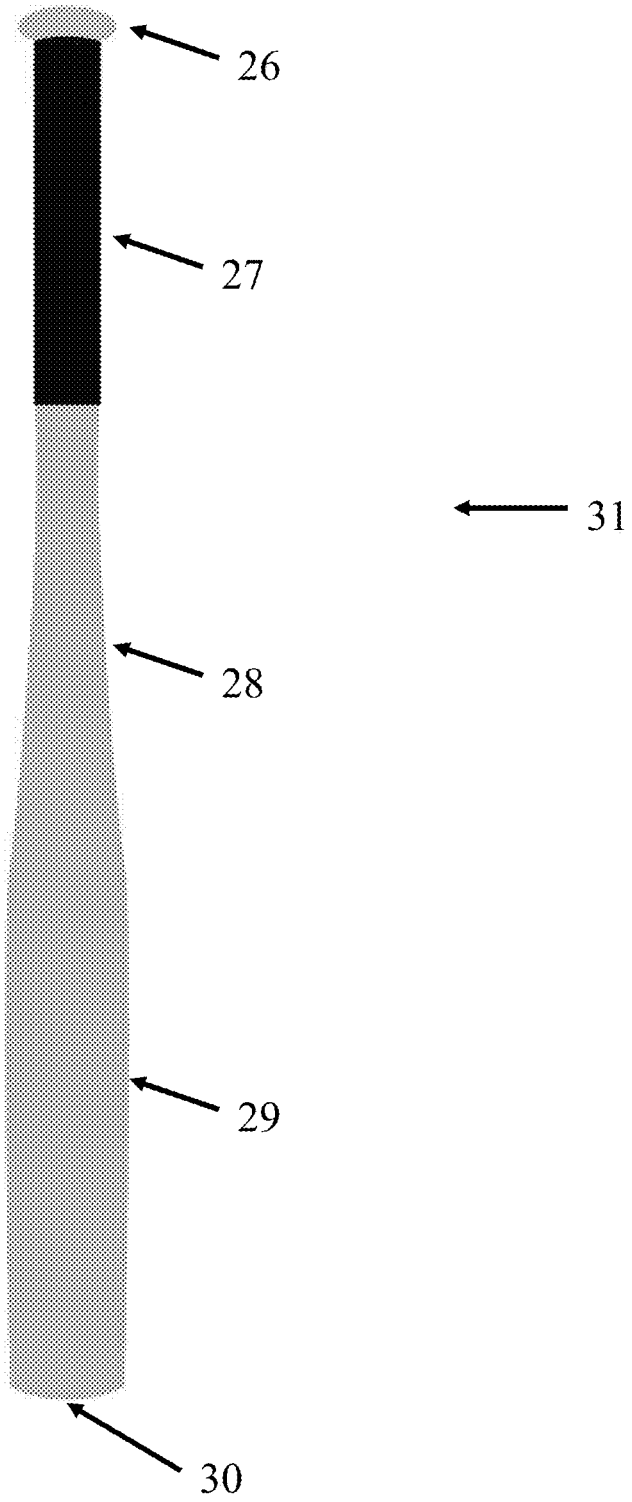
FIG. 13 is a side view of a bat.

FIG. 13 is a side view of a typical bat 31. The bat has a knob 26, grip 27, tapered section 28, a barrel 29, and an end 30. The proportions of each part of the bat may vary depending on the exact sport (e.g., t-ball, baseball, softball) and league (e.g., club leagues, Little League, NCAA, MLB). Common dimensions for various types of bat barrels are set out in Table 2 below.

TABLE 2

| Type of Bat | Typical Max Barrel Width at Widest Point | Typical Length of Bat |
|---|---|---|
| USSSA Small Barrel | Width <= 2&¼" | 26-28" |
| BBCOR Bat | Width <= 2&⅝" | 28-36" |
| Major League Baseball | Width <= 2&¾" | 32-36" |

With respect to Table 1 above, the aperture may vary based on the targeted type of baseball bat or softball bat. Note that some types of bats are larger or smaller than regulation and used for practice or other types of activities, and so larger or smaller apertures may be more useful for them.

Figure 14:
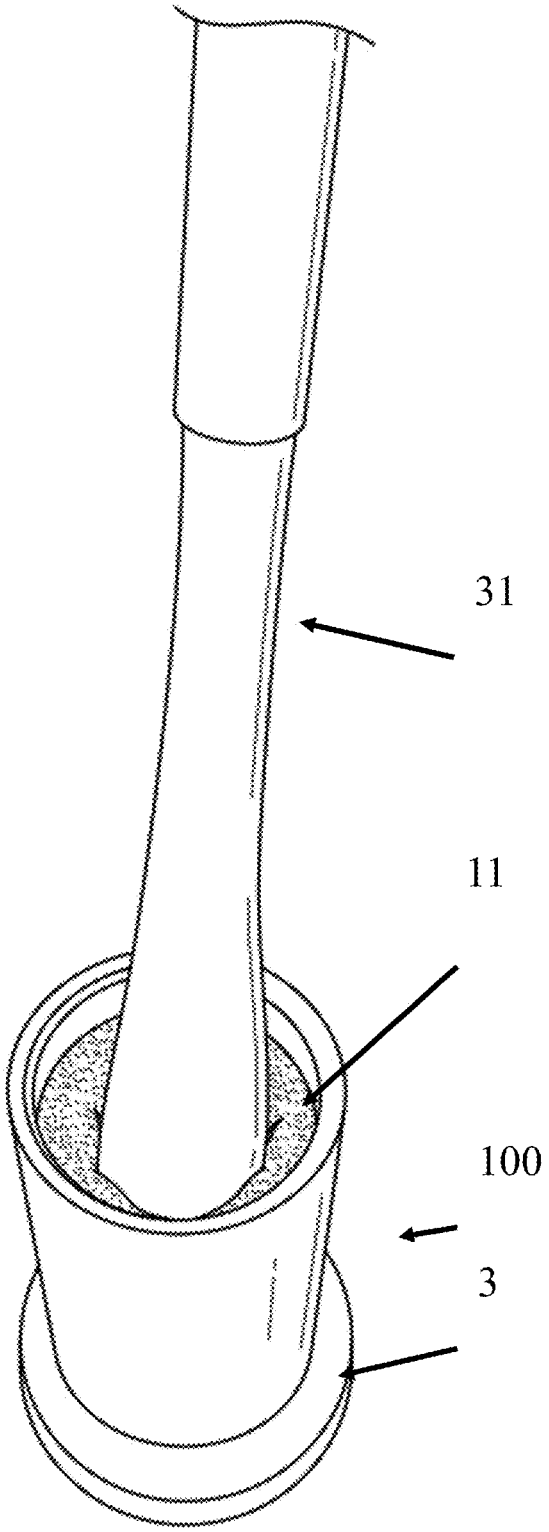
FIG. 14 is a perspective view of a baseball bat resting in an embodiment of a stand for a bat.

FIG. 14 is a perspective view of a bat 31 vertically resting in a stand 100. The finger plate 11 keeps the bat erect and the center of gravity of the combination of the stand 100 and bat 31 roughly along vertical axis of the stand 100. The base 3 permits the bat to deviate somewhat from the vertical axis of the cylinder without tipping over.

Figure 15:
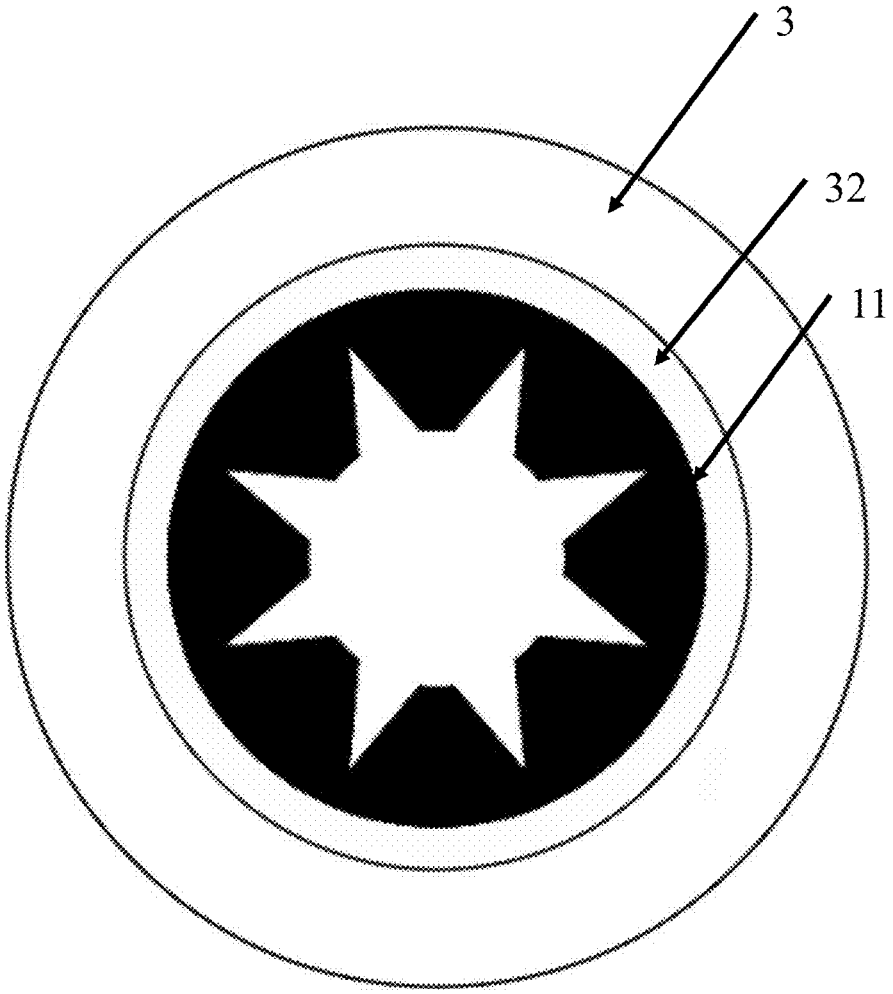
FIG. 15 is a bottom view of an embodiment of a stand.

FIG. 15 is a bottom view of the stand 100. In this embodiment, the base 3 does not cover the entire bottom of the stand 100. The interior surface 32 of the body is visible, as the finger plate 11 is on the upper half of the body. In some embodiments, an additional finger plate (not shown in FIG. 15) may be present near the base so that balls may be inserted into the stand and not immediately fall through the body. A finger plate on the lower half of the body may also further help align the center of gravity of the bat with the central axis of the bat stand. A finger plate on the lower half of the body may be attached as discussed with respect to finger plates attached to the upper half of the body, simply substituting the base for the ring (e.g., as described with respect to FIGS. 6-9 and 16-18). In some embodiments, the base 3 covers the bottom hole of the body.

Backpacks and buckets and other portable containers are often used to transport bats from one location to another, for example, from home to a playing field. In some embodiments, the bat stand may be stored in a portable container along with the bat. The bat may rest in the stand, and the stand rests in the container. When there is a relatively close correlation between the bat barrel and the bat stand, the bat stand may be transported while taking up relatively little additional volume in the container.

In some embodiments, brushes (e.g., nylon brushes) may be used as part of, or in place of, a finger plate. In one embodiment, the brush strands may be inserted into the interior wall of the bat stand and extend into (or past) the center of the bat stand in a fingerlike fashion, allowing bats to slide in and out of the stand with the brushes providing minimal resistance. In one example the brush strands are inserted into holes in the interior of the bat stand on the upper half where, for example, a finger plate might reside. In some embodiments the brushes may be part of a finger plate and embedded into a thin plastic, rubber, or metal ring and held as other types of finger plates as described with respect to FIGS. 6-9, and 16-18. In some other embodiments, the bat stand's dimensions may be adjusted to support elongated objects such as brooms, mops, shovels, rakes, poles, hockey sticks, lacrosse sticks, tennis rackets, cricket bats, pool sticks, golf clubs, and other elongated objects.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature, or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes, and substitutions are intended in the foregoing disclosures, and it will be appreciated that in some instances some features of embodiments of the invention will be employed without a corresponding use of other features.

Reference throughout this specification to "one embodiment", "an embodiment", "another embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. While the invention may be illustrated by using a particular embodiment, this is not and does not limit the invention to any particular embodiment and a person of ordinary skill in the art will recognize that additional embodiments are readily understandable and are a part of this invention.

What is claimed is:

1. An apparatus for storing a bat, the apparatus comprising:

a body having an upper half, a lower half, and one or more walls defining a cavity within the body, the cavity adapted for the vertical storage of a bat;

a base located on the lower half of the body;

a finger plate comprising a plurality of fingers to keep the bat centered in the body; and a ring comprising a threaded portion, the threaded portion for connecting to a correspondingly threaded portion of the body, wherein the ring and body when threaded together secure the fingerplate to the upper half of the body in a gap between the ring and the body.

2. The apparatus of claim 1 wherein the body is cylindrical.

3. The apparatus of claim 1 wherein the base comprises a threaded portion, the threaded portion for connection to a correspondingly threaded portion of the body.

4. The apparatus of claim 1 wherein the base is integral with the body.

5. The apparatus of claim 1 further comprising a baseball bat resting vertically within the body.

6. The apparatus of claim 1 wherein the finger plate comprises tabs projecting radially outward from the center of the finger plate.

7. The apparatus of claim 1 wherein the finger plate comprises an aperture and a plurality of spikes radiating outward from the aperture, the aperture and spikes defined by two or more fingers.

8. The apparatus of claim 1 wherein the ring comprises, on a lower surface of the ring, a spike or ridge for securing the finger plate.

9. The apparatus of claim 1 wherein the body comprises, on an upper surface of the body, a spike or ridge for securing the finger plate.

10. The apparatus of claim 1 wherein the ring comprises, on an exterior surface of the ring, a hole to receive a screw that may traverse the ring radially from the exterior of the ring towards the center of the ring via the hole.

11. The apparatus of claim 1 wherein the body comprises, on an exterior surface of a wall of the body, a hole to receive a screw that may traverse the body wall radially from the exterior of the body towards the center of the body via the hole.

12. The apparatus of claim 1 wherein the ring comprises, on an exterior surface of the ring, a hole to receive a screw that may traverse the ring radially from the exterior of the ring towards the center of the ring via the hole.

13. The apparatus of claim 1, wherein base is wider than the body.

14. An apparatus comprising:

a cylindrical body having an upper and a lower half, the body comprising:

a base located on the lower half of the body, and one or more walls defining a cylindrical cavity within the cylindrical body, the cavity having an interior surface;

a finger plate comprising a plurality of fingers; wherein the finger plate is disposed within a gap defined by the interior surface in the cavity of the body, the gap located on the upper half of the body.

15. The apparatus of claim 14, wherein the body has a top surface with a hole for a screw, and wherein the screw may enter the body through the hole and secure the finger plate within the gap.

16. The apparatus of claim 14, wherein the finger plate is secured in the gap with glue or epoxy.

17. The apparatus of claim 14, wherein the body has a top surface with a hole for a screw, and wherein the screw may enter the body through the hole and secure the finger plate within the gap by penetrating through the finger plate.

18. The apparatus of claim 14, wherein the base is wider than the body.

19. An apparatus comprising:

a body having an upper half, a lower half, a threaded hole on a top surface of the body, and one or more walls defining a cavity within the body;

a base wider than the body, the base located on the lower half of the body;

a ring comprising a hole extending from a top surface of the ring to a bottom surface of the ring; and a finger plate disposed on the upper half of the body between the ring and the body, the finger plate comprising a plurality of fingers, wherein a screw may traverse the hole in the ring and thread into the threaded hole of the body thereby securing the finger plate between the ring and the body.

20. The apparatus of claim 19 wherein the finger plate has a hole to permit the passage of the screw.

* * * * *